US008956046B2

(12) United States Patent
Umenaka et al.

(10) Patent No.: US 8,956,046 B2
(45) Date of Patent: Feb. 17, 2015

(54) BAG WITH PORT MEMBER AND CONNECTION STRUCTURE THEREOF

(75) Inventors: Kazuhiro Umenaka, Fujimino (JP); Takeshi Kojima, Yokohama (JP); Naomi Hashimoto, Yokohama (JP); Toshiyuki Yamagishi, Omachi (JP); Kanehide Oota, Omachi (JP)

(73) Assignees: Hosokawa Yoko Co., Ltd., Tokyo (JP); JGC Corporation, Tokyo (JP)

( * ) Notice: Subject to any disclaimer, the term of this patent is extended or adjusted under 35 U.S.C. 154(b) by 0 days.

(21) Appl. No.: 13/824,272

(22) PCT Filed: Nov. 22, 2011

(86) PCT No.: PCT/JP2011/076926
§ 371 (c)(1),
(2), (4) Date: May 30, 2013

(87) PCT Pub. No.: WO2012/070581
PCT Pub. Date: May 31, 2012

(65) Prior Publication Data

US 2013/0330024 A1 Dec. 12, 2013

(30) Foreign Application Priority Data

Nov. 22, 2010 (JP) ..... 2010-260606

(51) Int. Cl.
*B65D 33/16* (2006.01)
*B65D 71/50* (2006.01)
*B65D 75/58* (2006.01)

(52) U.S. Cl.
CPC ..... *B65D 33/16* (2013.01); *B65D 71/502* (2013.01); *B65D 75/5872* (2013.01); *Y10S 383/906* (2013.01)
USPC ..... 383/80; 383/81; 383/60; 383/906

(58) Field of Classification Search
USPC ..... 383/59, 60, 78, 80, 81, 93, 95, 96, 906
See application file for complete search history.

(56) References Cited

U.S. PATENT DOCUMENTS 3,427,646 A * 2/1969 Scholle ..... 53/281
4,290,466 A 9/1981 Villa et al.

(Continued)

FOREIGN PATENT DOCUMENTS

CN 101723123 A 6/2010
JP 32-14721 11/1957

(Continued)

OTHER PUBLICATIONS

International Search Report, PCT/JP2011/076926, dated Mar. 6, 2012.

(Continued)

*Primary Examiner* — Jes F Pascua
*Assistant Examiner* — Peter Helvey
(74) *Attorney, Agent, or Firm* — Nixon Peabody LLP

(57) ABSTRACT

A bag with a port member according to the present invention includes a bag having an opening and a port member attached to the opening. In addition, the port member has a tubular insertion portion and a bag side connection portion that is connected to a container side connection portion of other container, and the bag is positioned on the innermost circumferential face side of the bag with a port member on an inner face of the insertion portion. According to the bag with a port member, the bag with a port member that can reduce a residual amount of contents to be as small as possible when the contents inside the bag are taken out can be provided.

8 Claims, 11 Drawing Sheets

(56) References Cited

U.S. PATENT DOCUMENTS

| | | | | | |
|---|---|---|---|---|---|
| 4,368,766 | A * | 1/1983 | Nomi | 383/80 |
| 4,415,085 | A * | 11/1983 | Clarke et al. | 206/526 |
| 4,592,092 | A * | 5/1986 | McPhee | 383/80 |
| 5,000,236 | A | 3/1991 | Jemison | |
| 5,016,757 | A * | 5/1991 | Chatourel | 383/202 |
| 5,188,266 | A * | 2/1993 | Loulias | 224/148.6 |
| 5,882,119 | A * | 3/1999 | Fadal, II | 383/80 |
| 6,796,712 | B1 * | 9/2004 | Achhammer | 383/80 |
| 6,805,261 | B1 * | 10/2004 | Laudenberg | 222/107 |
| 7,988,008 | B2 * | 8/2011 | Banik et al. | 220/254.3 |
| 8,182,151 | B2 * | 5/2012 | Dodgen | 383/80 |
| 2002/0176639 | A1 * | 11/2002 | Crawley | 383/33 |
| 2004/0124210 | A1 | 7/2004 | Bartlein | |
| 2006/0110077 | A1 * | 5/2006 | Savage et al. | 383/66 |
| 2006/0182372 | A1 * | 8/2006 | Fadal et al. | 383/80 |
| 2009/0308777 | A1 * | 12/2009 | Banik et al. | 206/494 |

FOREIGN PATENT DOCUMENTS

| | | | |
|---|---|---|---|
| JP | 56-144753 | U | 10/1981 |
| JP | 59-7153 | U | 1/1984 |
| JP | 61-178340 | U | 11/1986 |
| JP | 2006-89133 | A | 4/2006 |
| JP | 089133 | A | 4/2006 |
| JP | 2006-198295 | A | 8/2006 |
| JP | 198295 | A | 8/2006 |
| JP | 3875717 | B1 | 1/2007 |
| JP | 3974185 | B | 9/2007 |
| JP | 4031430 | B2 | 1/2008 |
| JP | 2008-037482 | A | 2/2008 |
| JP | 4110803 | B2 | 7/2008 |
| JP | 2009-13285 | A | 1/2009 |
| JP | 4277086 | B2 | 6/2009 |
| JP | 2010-018326 | A | 1/2010 |
| JP | 2010-126170 | A | 6/2010 |
| WO | 03/007750 | A2 | 1/2003 |
| WO | 2010/054334 | A1 | 5/2010 |

OTHER PUBLICATIONS

Office Action in Japanese Application No. 2012-545768, mailed Jun. 11, 2013 (translation).

Office Action in Chinese Application No. 201180050506.8, mailed Jan. 23, 2014.

European Search Report in European Patent Application No. 11843128.7 mailed Mar. 18, 2014.

* cited by examiner

BAG WITH PORT MEMBER AND CONNECTION STRUCTURE THEREOF

CROSS REFERENCE TO RELATED APPLICATIONS OR PRIORITY CLAIM

This application is a National Phase of PCT/JP2011/076926, filed Nov. 22, 2011, entitled, "BAG WITH ATTACHED MOUTH MEMBER AND CONNECTION STRUCTURE OF SAID BAG", which claims the benefit of Japanese Patent Application No. 2010-260606, filed Nov. 22, 2010, the contents of which are incorporated herein by reference in their entirety.

TECHNICAL FIELD

The present invention relates to a bag with a port member that is provided with the port member attached to an opening of the bag and a connection structure of the bag with a port member.

BACKGROUND ART

In the pharmaceutical product manufacturing industry, drugs including source materials and pharmaceutical preparations are manufactured via various unit operations such as mixing, reacting, extracting, filtering, and purifying, using an isolator or a stainless steel tank for sterile formulation under a clean environment. When one unit operation is transitioning to the next unit operation, raw materials treated in such unit operations are transferred by being translocated to a connected line or a transfer container. Such transfer may be performed from a drug preparation section to a filling operation section within a factory, or performed between different factories such as an source material manufacturing factory and a pharmaceutical preparation manufacturing factory. In order to be prepared for a next process after one process is finished in each unit operation, a used tank, line, and the like are washed.

Washing is required to be completely performed, and since confirmation of complete washing is also included in the process, enormous effort and labor are required.

In recent years, for the purpose of avoiding washing that requires effort and labor, a technique of using a disposable flexible container instead of a tank or the like that is required to be washed has been developed, and particularly, such a trend has developed mainly in the bio-pharmaceutical product manufacturing industry. To be specific, a bag with a port member in which the port member that can be connected to a connection port of an existing facility such as a stainless steel tank is attached to an opening of a flexible bag has been used.

Such bags with a port member are disclosed in the following Patent Documents 1 and 2.

The bag with a port member disclosed in Patent Document 1 includes a flexible bag, a port member having a cylindrical part inserted into the bag from an opening of the bag, and a clamp that clamps the opening portion of the bag over the outer circumferential face of the cylindrical part inserted into the bag.

In addition, the bag with a port member disclosed in Patent Document 2 includes a flexible bag, and a port member having a cylindrical part inserted into the bag from an opening of the bag. The port member is attached to the bag in such a way that the outer circumferential face of the cylindrical part inserted into the bag adheres to the inner circumferential face of the opening portion of the bag.

CITATION LIST

Patent Documents

Patent Document 1: FIGS. 1 and 2 of Japanese Patent No. 3974185

Patent Document 2: FIG. 2 of Japanese Unexamined Patent Application, First Publication No. 2008-37482

SUMMARY OF INVENTION

Technical Problem

However, in both bags with a port member disclosed in Patent Documents 1 and 2, the inner faces of the bags and the outer faces of the cylindrical parts adhere or the like to each other, while the cylindrical parts of the port members are inserted into the bags from the openings of the bags. For this reason, when contents are taken out from the bag, contents remain in a corner of the inner circumferential face of the bag and an end face of the cylindrical part inserted into the bag. Particularly, when the contents are a very expensive drug or the like, losses in manufacturing costs of a product are considerable even when the residual amount of contents is small.

The present invention takes the above-described problem into consideration, and aims to provide a bag with a port member that can extremely reduce a residual amount of contents when the contents flow out of the bag.

Solution to Problem

In order to solve the problem, a first aspect according to the present invention provides a bag with a port member that includes a bag having an opening, and a port member attached to the opening, the port member has a tubular insertion portion and a bag side connection portion that is connected to a container side connection portion of another container, and the bag is positioned on the innermost circumferential face side of the bag with a port member on an inner face side of the insertion portion.

According to the first aspect, the bag is disposed so as to be positioned on the innermost circumferential face side of the bag with a port member on an inner face side of the port member. For this reason, a member or the like, into which a film to form the bag is tucked is not present inside the bag. Thus, since there is no obstruction inside the bag when contents of the bag flow out of the bag, a residual amount of contents can be reduced to be as small as possible.

In addition, according to a second aspect of the bag with a port member of the present invention, based on the first aspect, the bag with a port member having a tapered portion formed by reducing the thickness of the insertion portion at an end portion of the insertion portion on the bag side is provided.

According to the second aspect, by having the tapered portion formed by reducing the thickness of the insertion portion at an end portion of the insertion portion on the bag side, flexibility in the end portion of the insertion portion on the bag side improves, and the insertion portion can easily follow movements of the bag. As a result, even when a load is imposed on the bag at the periphery of the end portion, concentration of stress exerted to the bag is alleviated, and it is difficult to damage the bag.

In addition, according to a third aspect of the bag with a port member of the present invention, based on the first or the second aspects, the bag with a port member is provided in which the bag has seal parts, and thickness portions formed by increasing the thickness of the insertion portion are formed in portions that overlap the seal parts at the end portion of the insertion portion on the bag side.

According to the third embodiment, the peripheries of the seal parts are completely covered by the thickness portions, and the seal parts are securely supported by the port member. As a result, detachment of the seal parts from the port member occurring in the portions, damage to the port member resulting from the detachment, and incorporation of foreign substances into the contents are prevented.

In addition, according to a fourth aspect of the bag with a port member of the present invention, based on the first to the third aspects, the bag with a port member is provided in which the port member is formed in the periphery of the bag using insert molding.

According to the fourth aspect, since the port member is formed in the periphery of the bag using the insert molding, adhesiveness in a welded portion between the bag and the port member improves. As a result, a gap is not formed in the welded portion, and contents remaining in the gap can be prevented.

In addition, according to a fifth aspect of the bag with a port member of the present invention, based on the fourth aspect, the bag with a port member is provided in which a step portion formed by reducing the diameter of an inner circumferential face of the insertion portion toward the end portion side of the bag side is formed along the circumferential direction of the insertion portion, and the position of the step portion coincides with the position of an end face of the bag on the opening side.

According to the fifth aspect, even when a resin constituting the port member during the insert molding leaks on the opening side of the bag, the resin is kept in the step portion. For this reason, the resin does not hang on the inner side of the bag from an end face of the bag on the opening side.

In addition, according to a sixth aspect of the bag with a port member of the present invention, based on the first aspect, the bag with a port member is provided in which the bag has a neck in which the opening is formed and a bag main body that is connected on the side opposed to the side on which the opening of the neck is formed, the port member has a port member main body that includes the tubular insertion portion in which an insertion hole into which the neck of the bag is inserted is formed and a ring member into which the insertion portion is fitted on the inner circumference side, the bag is attached to the port member in such a way that the neck of the bag is inserted into the insertion hole from a bag main body side opening on one side out of openings on both ends of the insertion hole and comes out of the insertion hole from a connection side opening on the other side of the insertion hole, and in the neck, an opening side portion of the neck that comes out of the insertion hole is folded so as to follow an outer circumferential face of the insertion portion so as to be interposed between an inner circumferential face of the ring member and the outer circumferential face of the insertion portion that is fitted on the inner circumference side of the ring member, and the bag side connection portion is formed on either of an outer circumference side of the port member main body or of the ring member.

According to the sixth aspect, the neck of the bag is folded making the film forming the bag double in the neck, and the film on the outer circumferential side is tucked between the insertion portion disposed on the inner circumferential side and the ring member disposed on the outer circumferential side, and thus, in the bag on the bag main body side rather than the folded portion, there is no member into which the film forming the bag is tucked. Thus, according to the present invention, since there is no obstruction inside the bag when the contents of the bag flows out of the bag, the residual amount of contents can be reduced to be as small as possible.

In addition, according to a seventh aspect of the bag with a port member of the present invention, based on the sixth aspect, the bag with a port member is provided in which the port member main body has a flange portion as the bag side connection portion outwardly protruding along the radial direction of the insertion portion from a position that is on the outer circumferential face of the insertion portion and is on the bag main body side opening side with respect to the connection side opening of the insertion hole.

Since the flange portion is provided in the position which is on the bag main body side opening side with respect to the connection side opening of the insertion hole, when the flange portion is connected to another flange portion of other container, the connection side opening of the insertion portion is slotted into the connection port of the container. For this reason, according to the seventh aspect, when the contents of the bag are input to other container, outflow of the contents in the flange portion can be prevented.

In addition, according to an eighth aspect of the bag with a port member of the present invention, based on the sixth or the seventh aspect, the bag with a port member is provided on which one face of the inner circumferential face of the ring member or the outer circumferential face of the insertion portion, a convex portion that projects on the other face side is formed, and a concave portion into which the convex portion is fitted is formed on the other face side.

According to the eighth aspect, when the insertion portion is fitted to the inner circumference side of the ring member, the convex portion or the concave portion formed on the outer circumferential face of the insertion portion is fitted into the concave portion or the convex portion formed on the inner circumferential face of the ring member. Thus, when the insertion portion is fitted to the inner circumference side of the ring member, a relative position of the ring member with respect to the insertion portion in the direction in which the insertion hole extends is regulated.

In addition, according to a ninth aspect of the bag with a port member of the present invention, based on any one of the sixth to eighth aspects, the bag with a port member is provided in which the neck of the bag is not adhered to the inner circumferential face of the insertion hole, and thereby a portion of the neck that faces the inner circumferential face of the insertion hole can be relatively displaced on the inner circumferential face in a radial direction of the insertion hole.

Since the neck of the bag is not adhered to the inner circumferential face of the insertion hole, and the portion of the neck that faces the inner circumferential face of the insertion hole can be relatively displaced on the inner circumferential face in a radial direction of the insertion hole; when the bag main body is shaken during the taking out of the contents from the bag, the neck inside the insertion hole is also shaken along with the shaking of the bag main body, and a residual amount inside the bag can thereby be effectively reduced.

In addition, according to a tenth aspect of the bag with a port member of the present invention, based on any one of the sixth to ninth aspects, the bag with a port member is provided in which handles that are formed by outwardly extending the diameter of an outer circumferential face of the port member main body in the radial direction are formed, and positions of the handles define a range which is permitted to an operator in touching the port member main body during handling of the bag with a port member.

According to the tenth aspect, operability of the bag with a port member when an operator holds the handles further improves. In addition, since the positions of the handles define the range which is permitted to the operator in touching the port member main body during handling of the bag with a port member, the bag with a port member is advantageous in terms of quality management and hygiene without causing, for example, the operator to unnecessarily touch the end of the opening of the bag with a port member beyond the handles.

In addition, according to a first aspect of a connection structure of a bag with a port member of the present invention, a connection structure of a bag with a port member is provided which includes the bag with a port member described in any one of the first to tenth aspects, and a connection nozzle of other container to which the bag with a port member is connected, in which the connection nozzle has a container side connection portion to which the bag side connection portion of the bag with a port member is connected, and a connection portion into which at least one portion of the port member of the bag with a port member is slotted.

According to the first aspect of the connection structure of a bag with a port member, since at least one portion of the port member is slotted into the connection port of other container, outflow of contents to a connection portion when the contents of the bag are input into the container can be prevented.

Advantageous Effects of Invention

In the present invention, there is no member into which the film forming the bag is tucked in the bag attached to the inner face of the port member. Thus, according to the present invention, since there is no obstruction inside the bag when contents of the bag are taken out from the bag, a residual amount of contents can be reduced to be as small as possible.

DESCRIPTION OF EMBODIMENTS

Hereinafter, embodiments of a bag with a port member according to the present invention will be described using the drawings.

Figure 1:
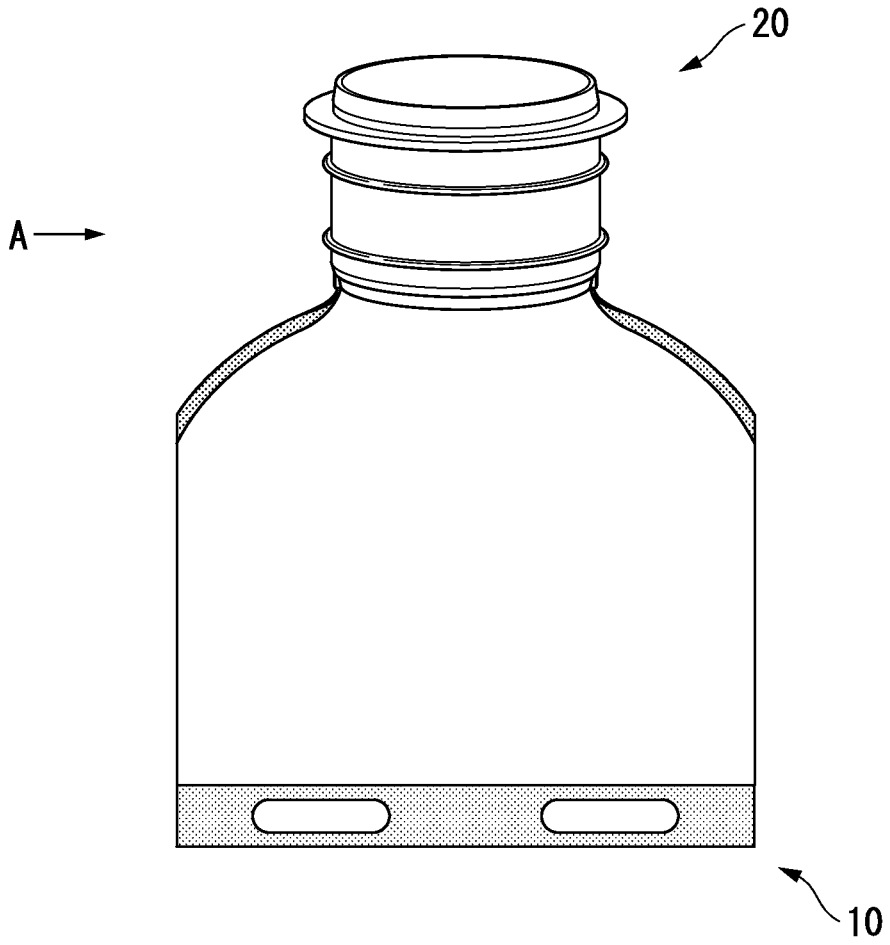
FIG. 1 is a front view of a bag with a port member according to a first embodiment of the present invention.

A bag with a port member according to a first embodiment of the present invention is configured such that a flexible bag 10 is fixed on an inner face of a hard port member 20 so as to be positioned on the innermost circumferential face side of the bag with a port member as shown in FIG. 1.

The bag 10 is formed by sealing the rims of, for example, two synthetic resin films using heat sealing or the like, or by sealing the rim of a tubular film obtained by performing inflation molding for a synthetic resin using heat sealing or the like.

As a synthetic resin to form the bag 10, a highly transparent thermoplastic resin that can be easily obtained such as polyethylene, polypropylene, or an ethylene vinyl acetate copolymer is preferable, but it is not limited thereto. In addition, any kind of additive may be added to the synthetic resin, but since there is a case in which a tiny amount of the additive may be incorporated into the contents of the bag, or the additive may alter the contents, addition of the additive should be avoided as far as possible. The thickness of a film depends on the capacity of the bag 10, but is about 50 μm to 1000 μm. In addition, the bag 10 may be a double bag having an inner bag and an outer bag. An advantage of a double bag, is considered to be, for example, that when an outer surface of the double bag is contaminated, only the inner bag may be transported into a clean area by removing the contaminated outer bag so as to prevent contamination of the clean area.

Figure 2:
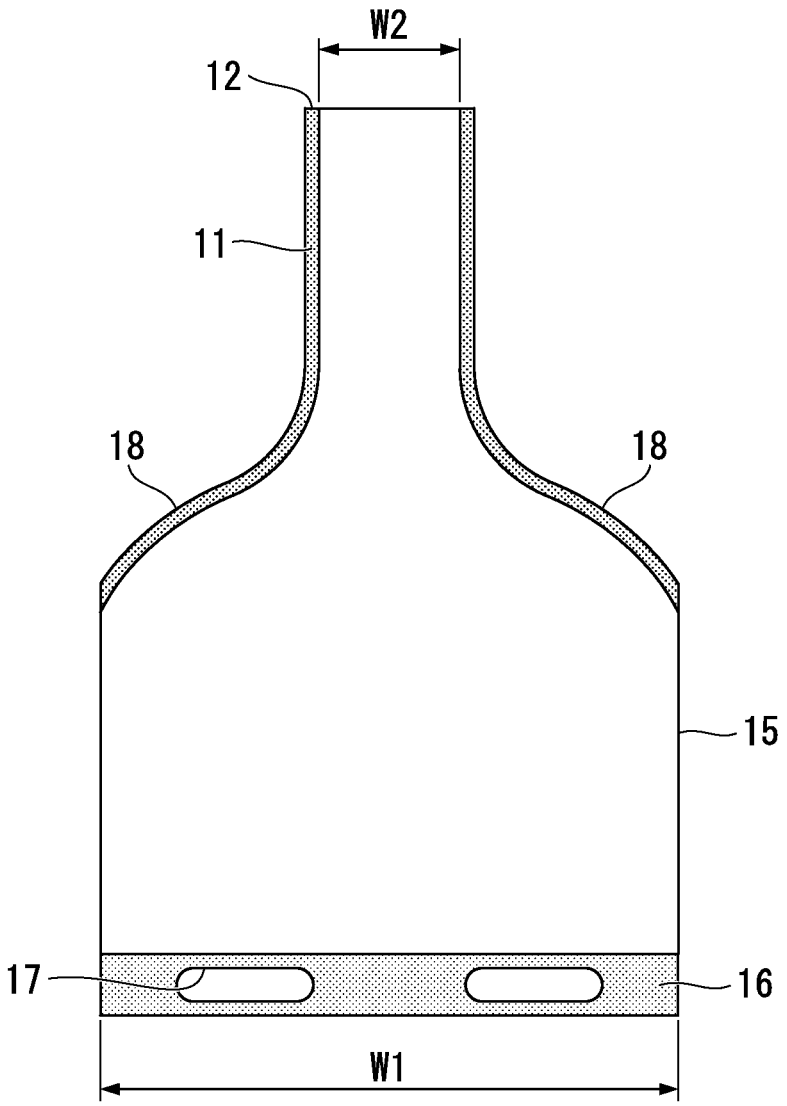
FIG. 2 is a front view of the bag according to the first embodiment of the present invention.

The bag 10 has a neck 11 in which an opening 12 is formed, and a bag main body 15 that is connected to the neck 11, as shown in FIG. 2. The width size W2 of the neck 11 is smaller than the maximum width W1 of the bag main body 15. The width size of the bag main body 15 gradually decreases moving closer to the neck 11, and has the same width size as that of the neck 11 in the portion connected to the neck 11. Two through holes 17 for holding the bag are formed in a bottom seal part 16 of the bag main body 15. The through holes 17 are used for grabbing the bag 10, or hanging the bag 10 on a rod-like object, and do not communicate with the inner space formed by the bag 10. In addition, the reference numeral 18 refers to seal parts formed inside edge portions of the bag 10 by performing heat sealing on the rim of the film constituting the bag 10.

Hereinafter, the bag with a port member according to the present embodiment will be described in more detail.

Figure 3:
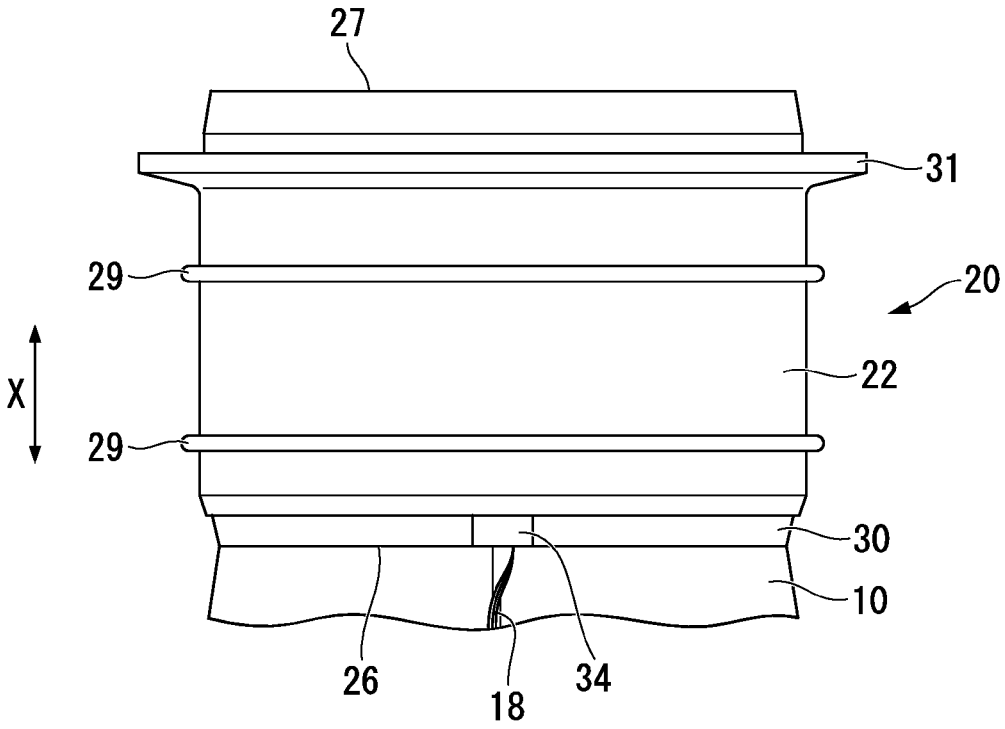
FIG. 3 is a side view taken along the arrow A of the port member in FIG. 1 according to the first embodiment of the present invention.
Figure 4:
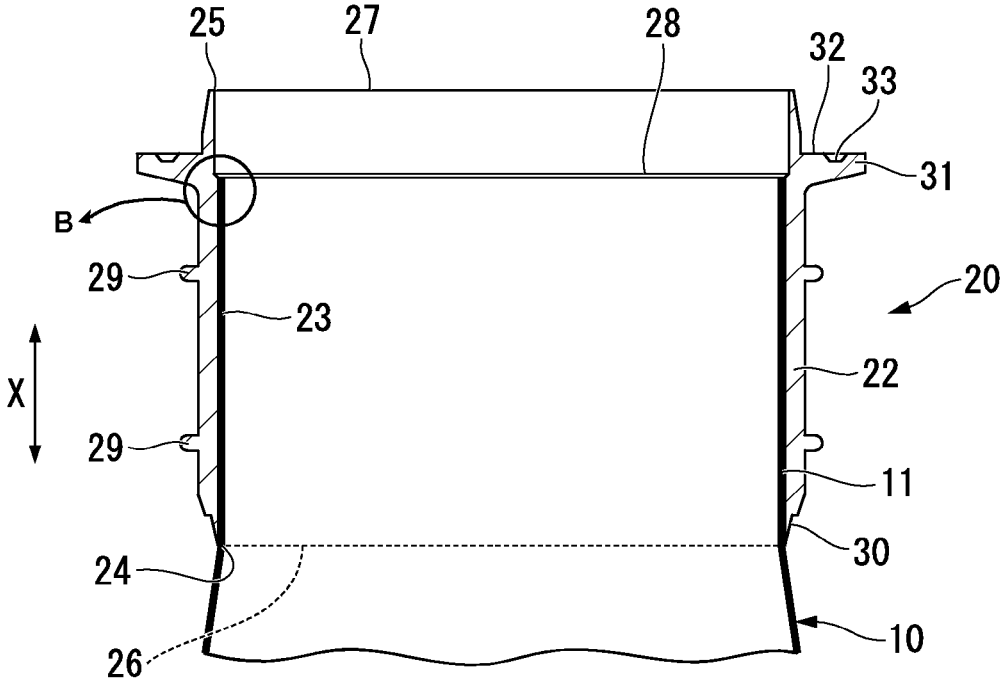
FIG. 4 is a cross-sectional view of the port member according to the first embodiment of the present invention.

The port member 20 is a member in which an insertion hole 23 into which the neck 11 of the bag 10 is inserted is formed, and has a cylindrical insertion portion 22 in which the above-described insertion hole 23 is formed, and a flange portion 31 that is formed in the outer circumference of the insertion portion 22 as a connection portion, as shown in FIGS. 3 and 4. In addition, the outer circumferential face of the neck 11 of the bag 10 is tightly fixed to the inner circumferential face of the insertion portion 22 using welding. As a specific welding method, an insert molding to be described later is exemplified.

With regard to both end faces 26 and 27 of the insertion portion 22, a bag main body side opening 24 of the insertion hole 23 is formed on the end face 26 on the bag main body side, and a connection side opening 25 of the insertion hole 23 is formed on the end face 27 on the connection side. In description hereinbelow, an extension direction of the insertion hole 23 is set to the X direction, the side of the connection side opening 25 (upper side in the drawings) is set to one end side in the X direction, and the side of the bag main body side opening 24 (lower side in the drawings) is set to the other end side in the X direction.

The flange 31 that is formed by outwardly extending the outer circumferential face of the insertion portion 22 along a radial direction of the insertion portion 22 is formed in the periphery of the end face 27 on the connection side. In other words, the flange 31 that extends in a direction perpendicular to an axial line of the insertion portion 22 is formed on the outer circumferential face of the insertion portion 22, which is in a position on the side of the connection side opening 25 of the insertion hole 23. A face that faces the one end side in the X direction of the flange 31 forms a connection face 32, and a circular seal groove 33 that is recessed on the other end side in the X direction is formed on the connection face 32 so as to be coaxially aligned with the insertion portion 22.

Figure 5:
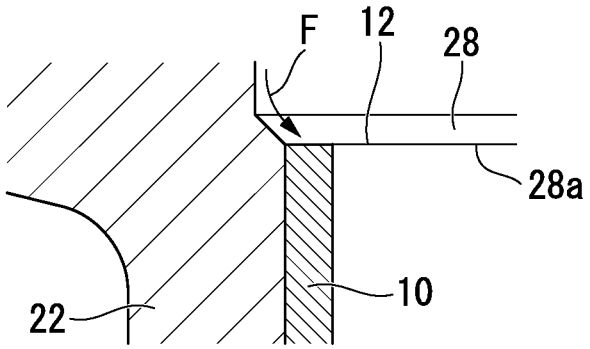
FIG. 5 is an enlarged cross-sectional view of a portion of the port member indicated by a sign B in FIG. 4 according to the first embodiment of the present invention.

The outer diameter of a portion of the insertion portion 22 positioned on the one end side in the X direction with respect to the flange portion 31 gradually decreases toward the one end side in the X direction. In addition, a step portion 28 formed by gradually reducing the diameter of the inner circumferential face of the insertion portion 22 along the other end side in the X direction is formed in the periphery of the end face 27 on the connection side along the circumferential direction of the insertion portion 22 as shown in FIG. 5. In addition, the position of an end edge 28*a* of the step portion 28 on the other end side mentioned above coincides with the position of an end face of the bag 10 on the opening 12 side.

Out of the outer circumferential face of the insertion portion 22, handles 29 formed by outwardly expanding the outer circumferential face of the insertion portion 22 along the radial direction are formed respectively on the other end side in the X direction of the flange 31 and the one end side in the X direction of the end face 26 on the bag main body side. Herein, the outwardly projecting dimensions of the handles 29 in the radial direction are smaller than that of the flange 31. In addition, the formation positions of the handles 29 are decided so that the handles 29 are formed respectively on both end sides within a range which is permitted to an operator in touching the insertion portion 22 during handling of the bag with a port member. In other words, the positions of the handles 29 define the range which is permitted to an operator in touching the insertion portion 22 during handling of the bag with a port member.

In the case of the present embodiment, the one end side in the X direction of the flange portion 31 serves as a connection portion with a tank (to be described later) to which the bag with a port member is connected, and thus, touching this portion by an operator is not favorable in terms of incorporation of foreign substances into the contents of the bag. In addition, since the other end side in the X direction of the end face 26 on the bag main body side is formed of the flexible bag 10, touching this portion by an operator is not favorable in terms of operability and prevention of damage to the bag. Thus, two extended diameter portions of which the diameters outwardly extend in the radial direction along the circumferential direction of the outer circumferential face of the insertion portion 22 are provided between the flange portion 31 and the end face 26 on the bag main body side, and the extended diameter portions respectively serve as the handles 29.

Figure 6:
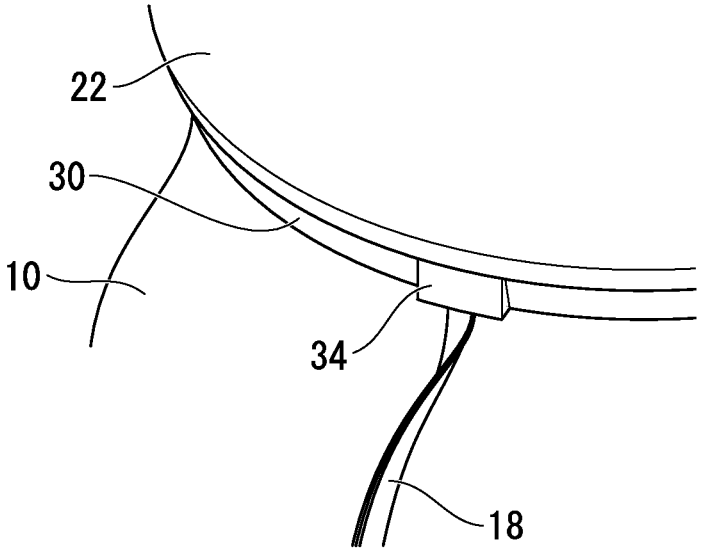
FIG. 6 is an upper perspective view of a connected portion of the port member and the bag showing an example of a configuration of a thickness portion of the port member according to the first embodiment of the present invention.

An end portion of the insertion portion 22 on the other end side in the X direction forms a tapered portion 30 of which the diameter gradually decreases on the outer circumferential face of the insertion portion 22 on the other end side. As a result, the other end edge of the tapered portion 30 coincides with the end face 26 on the bag main body side. In addition, thickness portions 34 of which thickness increases along the radial direction of the tapered portion 30 is formed in portions of the tapered portion 30 which the seal parts 18 formed on side edge portions of the bag 10 overlap. The thickness portions 34 are formed on two points at positions symmetric by 180 degrees along the circumference direction such as the portions in which the tapered portion 30 overlaps the seal parts 18. The thickness portions 34 prevent the seal parts 18 from being exposed on the side face of the thickness portions 34 by covering the seal parts 18 bending in the circumference direction of the bag 10 thereover, and cause the seal parts 18 to be securely supported by an end portion of the port member 20 on the other end side in the X direction as shown in FIGS. 3 and 6.

The port member 20 described hereinabove is insert-molded integrally with the bag 10 in such way that the bag 10 is placed inside a die for injection molding (not shown), a molten resin is injected around the neck 11, and the outer circumferential face of the bag 10 thereby comes into tight contact with the inner circumferential face of the insertion hole 23. In this case, using a die having a parting line thereof at a position in which the parting line does not overlap a line linking the two thickness portions 34, preferably at a position in which the parting line is orthogonal to the line linking the thickness portions 34 is preferable in that the thickness portions 34 can securely cover the seal parts 18.

In addition, a material of the port member 20 is preferably the same as that of the bag 10. The port member 20 is formed of, for example, a polyolefin resin such as polyethylene, or polypropylene, a thermoplastic resin such as polyacetal, an ABS resin, polyester, polyamide, polysulfone, polycarbonate, or polyethersulfone. Among these synthetic resins, a polyolefin resin is preferable in that it has suitable rigidity and excellence in moldability, and polyethylene is more preferable in that it deteriorates little during gamma sterilization. In addition, these synthetic resins preferably have no additives, but, when the contents are powder, an antistatic agent such as a surfactant-based additive or a conductive additive such as carbon may be mixed with the resins in order to prevent adhesion of the powdery contents to the bag with a port member.

The bag with a port member formed by performing the insert molding is sterilized by a radiation process of gamma rays, electron beams or the like after covering the connection side opening 25 with a cap or packaging the entire bag with a port member with another bag.

The sterilized bag is opened in, for example, a clean area of a pharmaceutical preparation manufacturing factory, connected to a tank or the like, in the area, and then contents of the tank are input into the bag 10 of the bag with a port member. Then, this bag with a port member is connected to another tank so that contents of the bag are input into the tank in order to perform a predetermined operation on the contents in the bag 10.

Herein, a configuration of the tank to which the bag with a port member is connected will be described.

Figure 7:
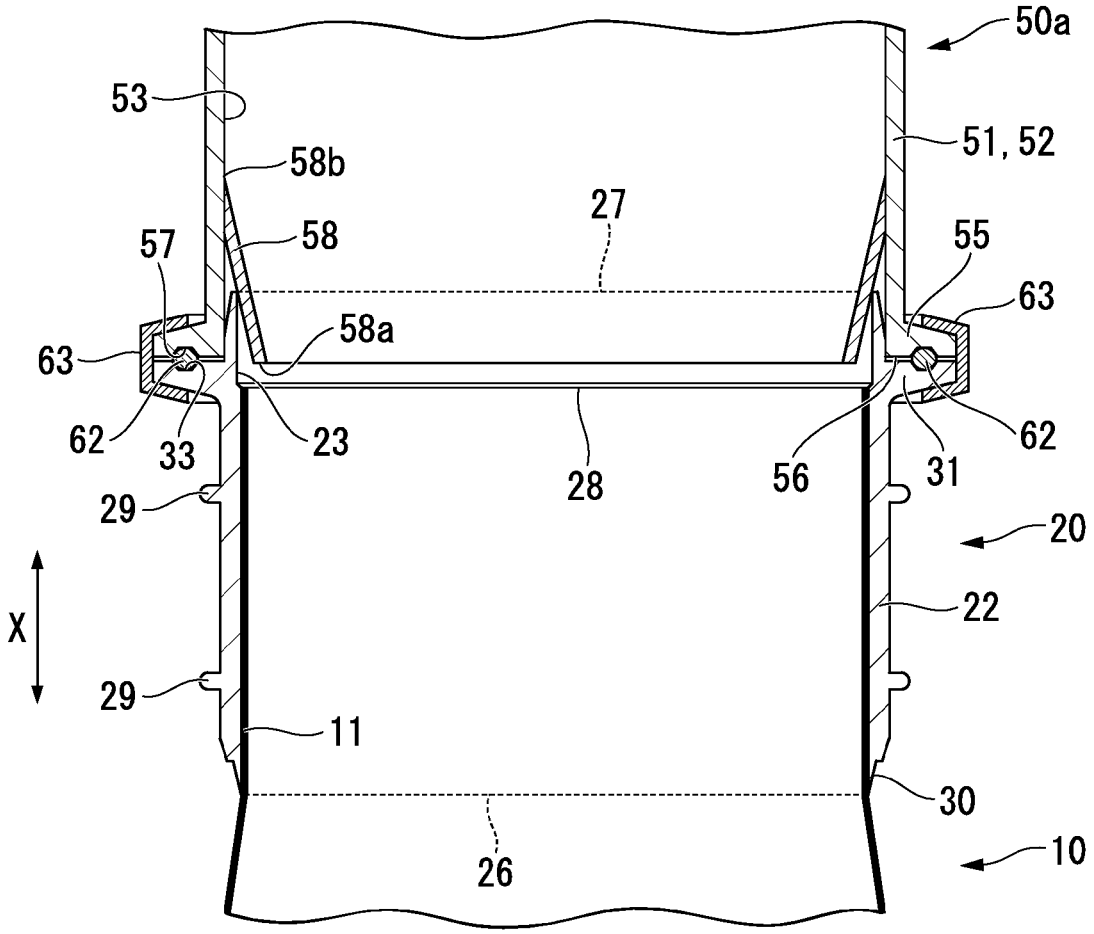
FIG. 7 is a cross-sectional view of a connection nozzle of the port member and a supply tank according to the first embodiment of the present invention.
Figure 8:
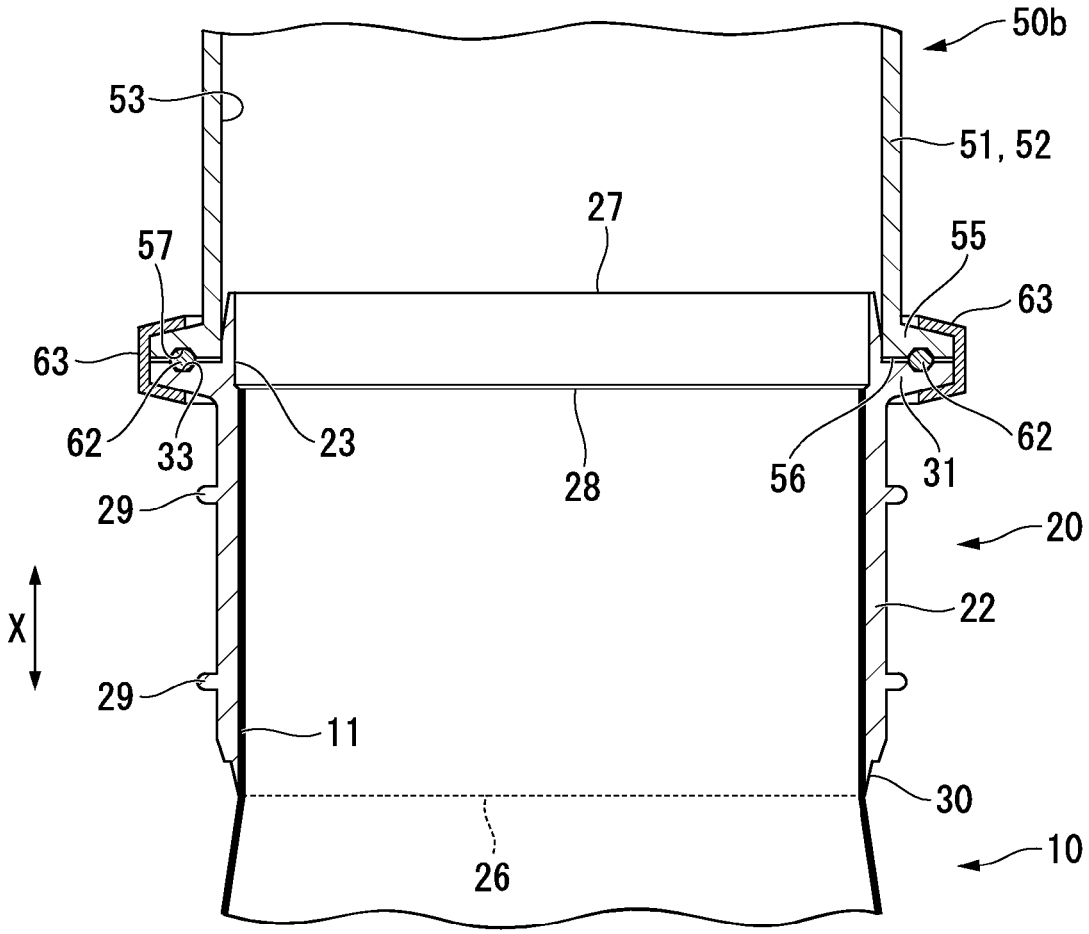
FIG. 8 is a cross-sectional view of a connection nozzle of the port member and a receiving tank according to the first embodiment of the present invention.

In the present embodiment, as the tank to which the bag with a port member is connected, there are a supply tank 50*a* that supplies contents to the bag with a port member as shown in FIG. 7, and a receiving tank 50*b* that receives the contents from the bag with a port member as shown in FIG. 8.

Both of the supply tank 50*a* and the receiving tank 50*b* have tank main bodies (not shown) and connection nozzles 51 formed in the tank main bodies. Each connection nozzle 51 is called a sanitary ferrule, and has a cylindrical connection tube 52 in which a connection port 53 that is linked to the inside of the tank main body is formed on an inner circumferential side and a flange portion (connection portion on the container side) 55 that is formed on the outer circumference of the end portion of the connection tube 52.

The inner diameter of the connection tube 52, in other words, the opening diameter of the connection port 53 is substantially the same as the maximum outer diameter of a portion of the insertion portion 22 positioned on the one end side in the X direction with respect to the flange portion 31. In addition, the outer diameter of the flange portion 55 is the same as that of the flange portion 31 of the port member 20.

On a connection face 56 of the flange portion 55, a circular seal groove 57 that is recessed on the one end side in the X direction (on the tank main body side) is formed so as to be coaxially aligned with the connection tube 52. Each dimension of the seal groove 57 corresponds to that of the seal groove 33 of the flange portion 31 of the port member 20. In other words, the diameters and depths of both seal grooves 33 and 57 are substantially the same.

The connection nozzle 51 of the supply tank 50*a* has a chute 58 that is disposed inside the connection port 53, in addition to the above-described connection tube 52 and the flange portion 55 as shown in FIG. 7. The chute 58 has a diameter that gradually decreases toward the connection side opening 25 of the port member 20, and an end portion 58*b* that is a portion having the maximum diameter of the chute 58 is connected to an inner circumferential face disposed inside the connection port 53. Note that, as a material of the chute 58, the same material as the supply tank 50*a* and the connection nozzle 51 is used, and the same thermoplastic resin as the port member 20 as described above is used for the formation. In addition, the end portion 58*b* may not be connected to the inner circumferential face of the connection port 53. In this case, the chute 58 may be slotted into the connection side opening 25 so as to abut thereon to be supported by the opening. Another end portion 58*a* of the chute 58 on the other end side in the X direction has an outer diameter that is smaller than the inner diameter of the connection side port 25 of the port member 20, and is positioned at the same position as the connection face 56 of the flange portion 55 in the X direction. Note that, in the chute 58, the outer diameter of the end portion 58*a* on the other end side in the X direction may be smaller than the inner diameter of the connection side opening 25 of the port member 20, may gradually decrease, or for example, may have a portion that has the same diameter as the inner diameter. A shutter (not shown) that controls outflow of the contents from the tank main body to the connection port 53 is provided in the connection nozzle 51 of the supply tank 50*a* or in the tank main body.

Note that the connection nozzle 51 of the supply tank 50*a* is installed on the lower side of the tank main body, and the bag with a port member is installed in the lower part of this connection nozzle 51. Thus, the one end side in the X direction is the upper part in FIG. 7. In addition, the connection nozzle 51 of the receiving tank 50*b* is installed on the upper side of the tank main body, and the bag with a port member is installed in the upper part of the connection nozzle 51. Thus, the one end side in the X direction is the lower part in FIG. 8.

Next, an input of the contents from the supply tank 50*a* into the bag with a port member will be described using FIG. 7.

First, an O-ring 62 is fitted into the seal groove 33 of the flange portion 31 of the bag with a port member. Next, the connection faces 32 and 56 of both flange portions 31 and 55 are set to be facing so that the O-ring 62 fitted into the seal groove 33 is fitted into the seal groove 57 of the flange portion 55 of the supply tank 50*a*, and the bag with a port member thereby approaches the supply tank 50*a*.

As the flange portion 31 of the bag with a port member approaches the flange portion 55 of the supply tank 50*a*, the one end portion of the insertion portion 22 in the X direction starts to be slotted into the connection port 53 of the supply tank 50*a*. As described above, the opening diameter of the connection port 53 is substantially the same as the maximum outer diameter of the portion of the insertion portion 22 positioned on the one end side in the X direction with respect to the flange portion 31. In addition, the outer diameter of the portion of the insertion portion 22 positioned on the one end side in the X direction with respect to the flange portion 31 gradually decreases along the one end side in the X direction, and is the minimum on the end face 27 on the connection side. For this reason, even when the flange portion 31 of the bag with a port member is a little deviated from the flange portion 55 of the supply tank 50*a* in the direction perpendicular to the X direction in the course in which the flange portion 31 of the bag with a port member approaches the flange portion 55 of the supply tank 50*a*, the outer circumferential face of the insertion portion 22 functions as a guide in that direction, and such deviation in that direction is corrected.

In addition, when one end portion of the insertion portion 22 in the X direction starts to be slotted into the connection port 53 of the supply tank 50*a*, the chute 58 of the supply tank 50*a* starts to be slotted into the insertion hole 23 of the bag with a port member. In other words, the one end portion of the insertion portion 22 in the X direction starts to be slotted into a gap formed between an inner circumferential side of the connection port 53 of the supply tank 50*a* and an outer circumferential side of the chute 58 of the supply tank 50*a*.

As the flange portion 31 of the bag with a port member further approaches the flange portion 55 of the supply tank 50*a*, the O-ring 62 that has been fitted into the seal groove 33 of the flange portion 31 of the bag with a port member starts to be fitted into the seal groove 57 of the flange portion 55 of the supply tank 50*a*. The O-ring 62 that has been fitted into the seal groove 33 of the flange portion 31 of the bag with a port member is a convex member against the flange portion 55 of the supply tank 50*a*. For this reason, this O-ring 62 also functions as positioning means relative to the flange portions 31 and 55 in the axial direction of the flange portions 31 and 55, together with the inclined outer circumferential face of the one end portion of the insertion portion 22 in the X direction. For this reason, relative positions of both flange portions 31 and 55 can be correctly determined during connection of both flange portions 31 and 55.

When the inner circumferential face of the connection portion 53 of the supply tank 50*a* comes into contact with the outer circumferential face of the one end portion of the insertion portion 22 in the X direction, the flange portion 31 of the bag with a port member no longer approaches the flange portion 55 of the supply tank 50*a*. Thus, at this point of time, relative positions of both flange portions 31 and 55 are determined in the X direction and the direction perpendicular to the X direction.

When the relative positions of both flange portions 31 and 55 are determined in the X direction and the direction perpendicular to the X direction, both flange portions 31 and 55 are connected to each other using a connecting clamp 63. As the connecting clamp 63, for example, there is a clamp defined as an ISO ferrule union joint.

When connection of both flange portions 31 and 55 is completed, the contents in the tank main body of the supply tank 50*a* are input into the bag with a port member by opening a shutter (not shown) in the supply tank 50*a*.

In the stage in which connection of both flange portions 31 and 55 is completed, the tip of the chute 58 of the supply tank 50*a* is slotted into the insertion hole 23 of the bag with a port member. For this reason, the contents of the supply tank 50*a* are securely input into the bag 10 without flowing out of the bag 10 of the bag with a port member. In addition, since the O-ring 62 is interposed between the flange portions 31 and 55 as a seal member in the present embodiment as described above, leakage of contents from the connected portion of the flange portions 31 and 55 can be prevented.

Note that the O-ring 62 is used as a seal member in the above, but any seal member may be used as long as a portion to be fitted is provided in the seal grooves 33 and 57 of the respective flange portions 31 and 55, and for example, a gasket may be used instead of the O-ring 62.

Next, an input of contents from the bag with a port member to the receiving tank 50*b* will be described using FIG. 8.

Also in this case, the flange portion 31 of the bag with a port member is connected to the flange portion 55 of the receiving tank 50*b* in the same manner as the connection of the flange portion 31 of the bag with a port member and the flange portion 55 of the supply tank 50*a* as described above. However, in order not to cause contents of the bag with a port member to flow out in the connection process, the bag main body 15 is folded with respect to the neck 11 near the boundary line of the neck 11 of the bag 10 and the bag main body 15 (refer to FIG. 2) so that the bottom side of the bag main body faces downward.

When the connection of the flange portion 31 of the bag with a port member and the flange portion 55 of the receiving tank 50*b* is completed, the bag main body 15 is positioned higher than the neck 11 by holding up the bag main body 15 of the bag 10 so as to input the contents in the bag main body 15 into the receiving tank 52*b*.

When a hard member is attached to the flexible bag, there are many cases of using a method in which the periphery of the opening of the flexible bag is tucked between a hard member disposed on the inner circumference side and a hard member disposed on the outer circumference side, or a method in which an inner circumference face in the periphery of the opening of the flexible bag is made to adhere to an outer circumferential face of the hard member disposed on the inner circumferential face side. In this case, the hard member disposed on the inner circumference side of the bag serves as an obstruction when contents inside the bag are taken out from the bag, and the contents of the bag thereby are left in a portion of the hard member disposed on the inner circumference side. On the other hand, in the present embodiment, the outer circumferential face of the neck 11 of the bag 10 is tightly fixed to the inner circumferential face of the insertion portion 22 by performing welding in such a way that the bag 10 is positioned on the innermost circumferential side of the bag with a port member. For this reason, a member into which the film of the bag 10 is tucked or an adhering member is not present inside the bag 10. Thus, since there is no obstruction in the bag 10 when the contents of the bag are taken out from the bag 10 in the present embodiment, a residual amount of contents can be reduced.

In addition, in the present embodiment, the outer circumferential face of the neck 11 of the bag 10 is tightly fixed to the inner circumferential face of the insertion portion 22 by performing welding in which insert molding for forming the port member 20 by injecting a molten resin around the neck 11 of the bag 10 is performed, and thus, the inner circumferential face of the neck 11 of the bag 10 is smooth due to absence of a member for fixing the bag 10. For this reason, it is difficult for contents to be left around the neck 11. In addition, a gap (tunnel) is not formed in the tight contact portion of the bag 10 and the port member 20, thereby trapping of foreign substances in the gap can be prevented, and contamination of the contents caused by dislodging of the trapped foreign substances from the gap during an operation can be prevented. In addition, since a resin flows well in a die during the insert molding, a contact property of the bag 10 and the port member 20 is enhanced. As a result, in addition to the prevention of the formation of such a gap, airtightness of the bag with a port member is also enhanced. Furthermore, since there is not an assembly process for the bag 10 and the port member 20, friction debris of the resin accompanied with such an assembly or the like is not generated, and incorporation of foreign substances into the contents is thereby prevented. In addition, since the bag with a port member can be manufactured even though an operator does not touch the bag with a port member during assembly, the bag with a port member is advantageous in terms of hygiene.

In addition, the end portion of the insertion portion 22 on the other end side in the X direction forms the tapered portion 30 of which the diameter gradually decreases as the outer circumferential face of the insertion portion 22 goes along the other end side. Thus, the thickness of the insertion portion 22 in the tapered portion 30 becomes thin in comparison to one end side portion of the insertion portion 22 in the X direction, which improves flexibility. As a result, even when the bag main body 15 is rocked with respect to the port member 20 so that the contents left in the bag 10 are reduced when the contents are taken out from the bag with a port member, the tapered portion 30 gently follows the movement of the bag main body 15 extending from the tapered portion 30 to the other end side in the X direction, and concentration of stress exerted to the neck 11 from the end portion of the insertion portion 22 on the other end side in the X direction is alleviated. Thus, even when a load is imposed on the neck 11 at the end portion of the insertion portion 22 on the other end side in the X direction, it is difficult to damage the bag 10.

Furthermore, when the above-described insert molding is performed, relatively large pressure is exerted to the end portion of the insertion portion 22 on the other end side in the X direction. For this reason, there are cases in which the thickness of the bag 10 becomes thin as the bag 10 is pressurized in that portion due to being pressed by the molten resin. With regard to this matter, when the tapered portion 30 is formed, since the die for molding the above portion is tapered according to the shape of the tapered portion 30, pressure exerted to that portion when the insert molding is performed decreases. As a result, there is no case in which the thickness of the bag 10 does not become locally thin as the bag 10 is pressed by the molten resin.

The thickness portions 34 that increase the thickness along the radial direction of the tapered portion 30 are formed in a portion of the tapered portion 30 that overlaps the seal parts 18 formed in the side end portions of the bag 10. For this reason, peripheries of the seal parts 18 are completely covered by the thickness portions 34, exposure of the seal parts 18 on the side faces of the thickness portions 34 is prevented, and the seal parts 18 are securely supported by the end portions of the port member 20 on the other end side in the X direction. As a result, detachment of the seal parts 18 from the insertion portion 22 occurring in the end portions, damage to the port member 20 resulting from the detachment, and incorporation of foreign substances into the contents are prevented.

In addition, the step portion 28 is formed in the periphery of the end face 27 of the insertion portion 22 on the connection side along the circumference direction so that the position of the end edge 28*a* thereof coincides with the position of the end face of the bag 10 on the opening 12 side. As a result, as shown by the arrow F in FIG. 5, for example, even when the resin constituting the insertion portion 22 leaks on the opening 12 side of the bag 10 during the insert molding, the resin is kept in the step portion 28. For this reason, the resin does not hang on the inner side of the bag 10 from the end face of the bag 10 on the opening 12 side.

Furthermore, since the handles 29 are formed on the outer circumferential face of the insertion portion 22, the operability of the bag with a port member by an operator who frequently wears gloves in clean areas of the pharmaceutical product manufacturing industry further improves due to the use of the handles 29. In addition, since the positions of the handles 29 defines the range which is permitted to an operator in touching the insertion portion 22 during handling the bag with a port member, the positions are advantageous in terms of quality management and hygiene without causing, for example, the operator to unnecessarily touch the end of the opening of the bag with a port member beyond the handles 29.

Next, a bag with a port member according to a second embodiment of the present invention will be described below. Note that the same reference numerals as those of the members shown in FIGS. 1 to 8 are given to members having the same configuration as those in FIGS. 1 to 8, and a description thereof will not be repeated here.

Figure 9:
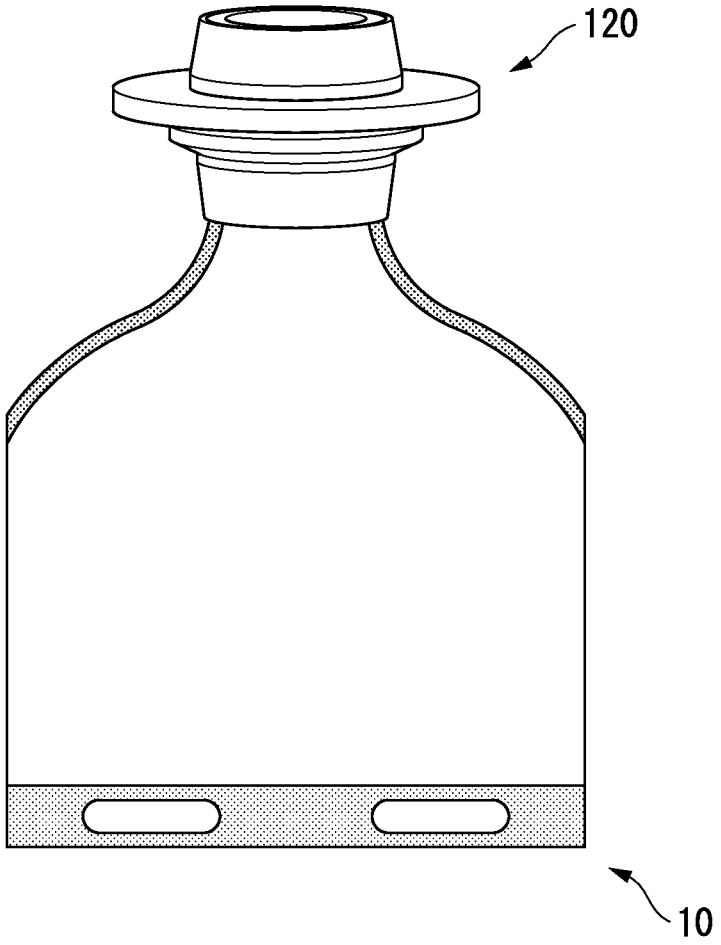
FIG. 9 is a front view of a bag with a port member according to a second embodiment of the present invention.

The bag with a port member of the present embodiment is configured such that the flexible bag 10 is placed on an inner face of a hard port member 120 so as to be positioned on the innermost circumferential face side of the bag with a port member, as shown in FIG. 9.

Figure 10:
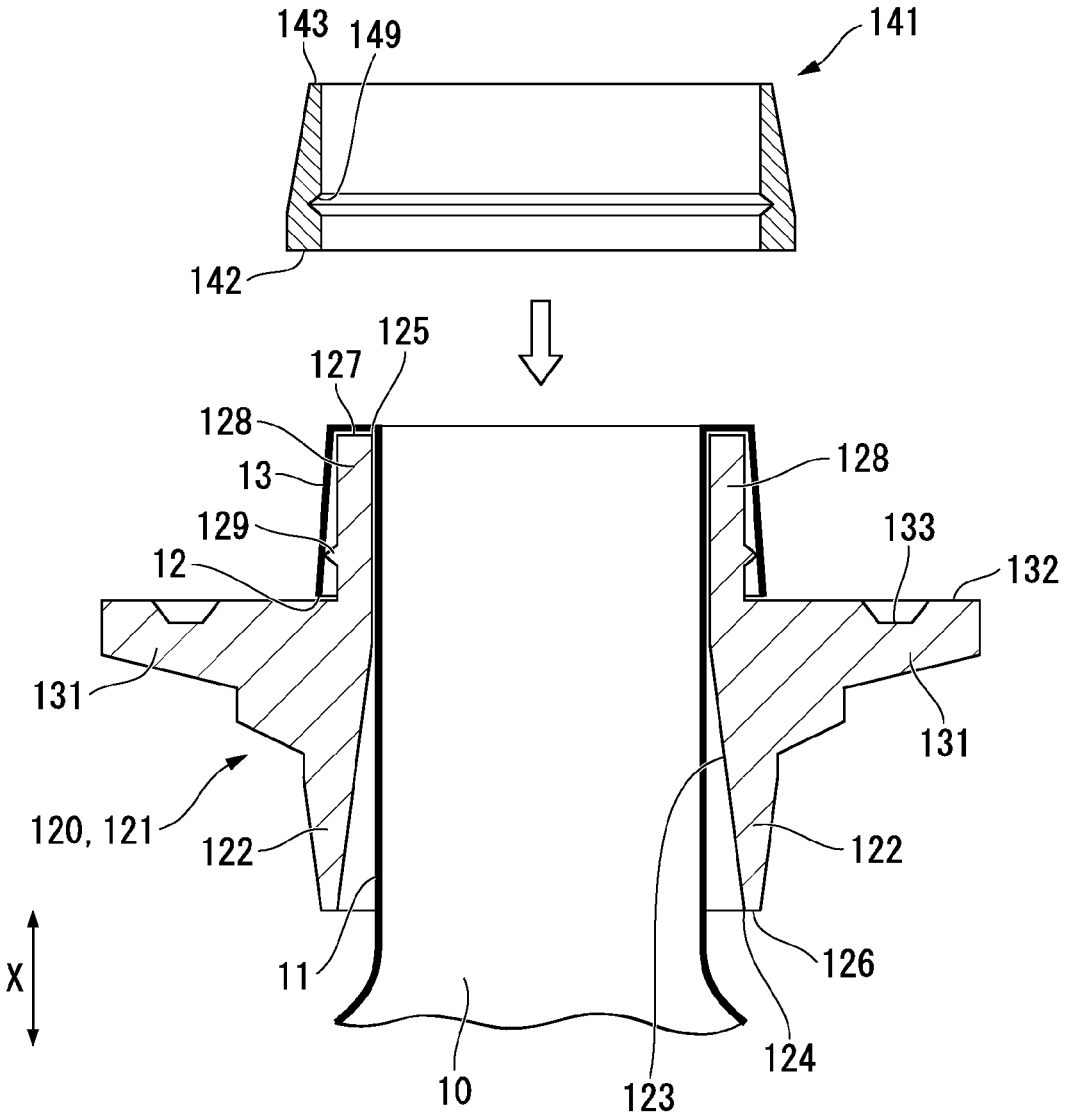
FIG. 10 is a developed cross-sectional view of the port member according to the second embodiment of the present invention.
Figure 11:
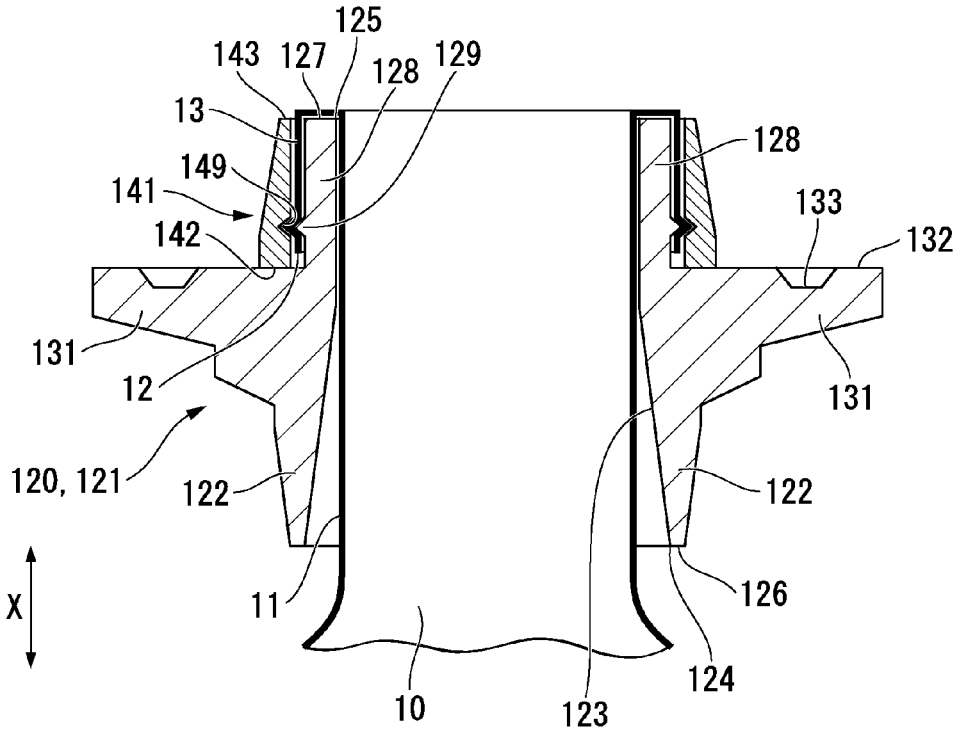
FIG. 11 is a cross-sectional view of the port member according to the second embodiment of the present invention.

The port member 120 includes a port member main body 121 in which an insertion hole 123 into which the neck 11 of the bag 10 is inserted is formed and a ring member 141 in which a portion of the port member main body 121 is fitted into the inner circumferential side thereof, as shown in FIGS. 10 and 11. The port member main body 121 has a cylindrical insertion portion 122 in which the above-mentioned insertion portion 123 is formed and a flange portion 131 that is formed in the outer circumference of the insertion portion 122 as a connection portion.

With regard to both end faces 126 and 127 of the tubular insertion portion 122, a bag main body side opening 124 of the insertion hole 123 is formed on the bag main body side end face 126 that is the end face on the other end side in the X direction, and a connection side opening 125 of the insertion hole 123 is formed on the connection side end face 127 that is the end face on one end side in the X direction.

The flange portion 131, which is formed by outwardly extending an outer circumferential face of the insertion portion 122 in the radial direction of the insertion portion 122, is formed in a position of the insertion portion 122 located between the connection side end face 127 and the bag main body side end face 126 in the X direction. In other words, the flange portion 131 that extends in the direction perpendicular to the axial line of the insertion portion 122 is formed in the position which is on the outer circumferential face of the tubular insertion portion 122 and on the bag main body side opening 124 side rather than the connection side opening 125 of the insertion hole 123. A face that faces one end side of the flange portion 131 in the X direction forms a connection face 132, and circular seal groove 133 that is recessed on the other end side in the X direction is formed on the connection face 132 so as to be coaxially aligned with the insertion portion 122.

A portion of the insertion portion 122 positioned on the one end side in the X direction with respect to the flange portion 131 forms a fitting portion 128 that is fitted into the inner circumference side of the ring member 141. A convex portion 129 that outwardly projects along the radial direction of the insertion portion 122 is formed in a position which is on an outer circumferential face of the fitting portion 128 and located between the connection side end face 127 and the connection face 132 of the flange portion 131 in the X direction.

The inner diameter of the insertion hole 123 in the fitting portion 128, that is, the inner diameter of a portion of the insertion hole 123 on the connection side opening 125 side is formed with the size obtained when the outer circumferential face of the neck 11 comes into contact with the inner circumferential face of the portion on the connection side opening 125 side when the neck 11 of the bag 10 is expanded in the direction perpendicular to the X direction. On the other hand, the diameter of a portion on the bag main body side opening 124 side of the insertion hole 123 gradually increases toward the bag main body side opening 124, and reaches the maximum at the position of the bag main body side opening 124. For this reason, when the neck 11 of the bag 10 is inserted into the insertion hole 123, there is almost no gap between a portion of the insertion hole 123 on the connection side opening 125 side and the outer circumferential face of the neck 11, but there is a gap between a portion of the insertion hole 123 on the bag main body opening 124 side and the outer circumferential face thereof in a state in which the seal parts at the edges of neck 11 are folded.

The inner diameter of the ring member 141 is substantially the same size that is obtained by adding the thickness of the film of the bag 10 to the outer diameter of the fitting portion 128 so that the fitting portion 128 of the insertion portion 122 is fitted into the member. In addition, the size of the ring member 141 in the X direction is substantially the same as that of the fitting portion 128 in the X direction. For this reason, in the state in which the fitting portion 128 of the port member main body 121 is fitted into the ring member 141, the end face 142 of the ring member 141 on the other end side in the X direction abuts on the flange portion 131 of the port member main body 121, and the other end face 143 of the ring member 141 on the one end side in the X direction is positioned to be practically leveled with the connection side end face 127 of the port member main body 121. In addition, when the fitting portion 128 of the port member main body 121 is fitted into the ring member 141, a concave portion 149 into which the convex portion 129 that is formed in the outer circumference of the fitting portion 128 is slotted is formed on the inner circumferential face of the ring member 141.

The outer diameter of the ring member 141 at the end portion on the other end side in the X direction is substantially the same as the opening diameter of the connection port 53 (refer to FIGS. 12 and 13) of the tank to which the bag with a port member is connected, and when the bag with a port member is connected to the tank, the outer circumferential face of the bag on the other end side in the X direction abuts on the inner circumferential face of the connection port 53 of the tank. In addition, the outer diameter of the ring member 141 on the one end side in the X direction gradually decreases toward the one end side in the X direction, and reaches the minimum on the end face 143 of the ring member 141 on the one end side in the X direction.

The port member main body 121 and the ring member 141 described above are formed of, for example, a polyolefin resin such as polyethylene, or polypropylene, a thermoplastic resin such as polyacetal, an ABS resin, polyester, polyamide, polysulfone, polycarbonate, or polyethersulfone. Among these synthetic resins, a polyolefin resin is preferable in that it has suitable rigidity and excellence in moldability, and polyethylene is more preferable in that it deteriorates little during gamma sterilization. In addition, these synthetic resins preferably have no additives, but, when the contents are powder, an antistatic agent such as a surfactant-based additive or a conductive additive such as carbon may be mixed with the resins in order to prevent adhesion of the powdery contents to the bag with a port member. For example, when a forming resin of the port member main body 121 that does not come into direct contact with the contents in the bag 10 or the connection port 53 of the tank on the connection counterpart side is mixed with a surfactant-based additive, if a forming resin of the bag 10 and the ring member 141 that can come into contact with the connection port 53 has no additive, transfer of an additive to the contents in the bag 10 and deterioration of the contents can be prevented while an antistatic effect is exhibited.

Next, a producing method of the bag with a port member will be described.

First, the bag 10 and the port member 120 described above are prepared.

Then, the neck 11 is put in the insertion hole 123 from the bag main body side opening 124 of the port member main body 121, and an opening side portion 13 of the neck 11 is taken out to the insertion hole 123 from the connection side opening 125 of the port member main body 121, as shown in FIG. 10. Then, the opening side portion 13 of the neck 11 taken out to the insertion hole 123 is folded outwardly so that the opening side portion 13 of the neck 11 faces the outer circumferential face of the fitting portion 128 of the port member main body 121.

Next, the neck 11 adheres to the port member main body 121. As will be described in detail, the bag 10 is disposed into the port member 120 in the present embodiment in such a way that the fitting portion 128 of the port member main body 121 is fitted into the ring member 141, and the folded opening side portion 13 of the neck 11 is interposed between the outer circumferential face of the fitting portion 128 and the inner circumferential face of the ring member 141. However, there is a case in which disposition strength of the bag 10 into the port member 120 is insufficient depending on the dimensions of each member. Thus, in the present embodiment, the neck 11 adheres to the port member main body 121.

Herein, an adhesive may be used for the adhesion, but in order to lower the possibility of foreign substances being incorporated as much as possible due to the fact that the bag with a port member is handled under a clean environment, it is preferable that the port member main body 121 and the neck 11 be melted so as to adhere to each other without using an adhesive. Specifically, adhesion using heat sealing, ultrasonic sealing, or high-frequency sealing is preferable.

In addition, as a portion of the port member main body 121 to which the neck 11 adheres, at least one face of the outer circumferential face of the fitting portion 128 of the port member main body 121 and the connection side end face 127 of the port member main body 121 is preferable, and particularly, the connection side end face 127 of the port member main body 121 is most preferable.

When powdery contents are taken out from the bag 10, there are cases in which the bag main body 15 is shaken with respect to the port member 120 so as not to leave contents in the bag 10. In this case, since shaking the neck 11 also to some degree with shaking of the bag main body 15 can reduce the residual amount of contents in the bag 10, it is preferable for the neck 11 not to adhere to the inner circumferential face of the insertion hole 123 of the port member main body 121.

In addition, when heat sealing, ultrasonic sealing, or high-frequency sealing is performed as described above, forming the adhesion face to be a flat face requires little effort and results in reliable adhesion during an adhering work. For this reason, it is preferable to adhere the outer circumferential face of the neck 11 to the flat connection side end face 127 of the port member main body 121 rather than to the outer circumferential face of the fitting portion 128 of the port member main body 121. In addition, the neck 11 is easily crinkled when the outer circumferential face of the neck 11 adheres to the outer circumferential face of the fitting portion 128 of the port member main body 121, and thus, in light of this point, it is preferable to adhere the outer circumferential face of the neck 11 to the connection side end face 127 of the port member main body 121.

Note that, when the neck 11 adheres to the outer circumferential face of the fitting portion 128 of the port member main body 121 using an adhesive, the outer circumference of the fitting portion 128 is configured to be covered by the ring member 141, and thus, in the present embodiment, risk of contamination by such an adhesive can be suppressed. In addition, even when the neck 11 adheres to the connection side end face 127 of the port member main body 121 using an adhesive, the connection side end face 127 is a face toward the direction in which the contents are discharged from the bag, and thus, in the present embodiment, risk of contamination by such an adhesive can be suppressed.

Next, the fitting portion 128 of the port member main body 121 is fitted into the ring member 141 from the other end side of the ring member 141 in the X direction, as shown in FIG. 11. In this process, the convex portion 129 formed on the outer circumferential face of the fitting portion 128 is fitted into the concave portion 149 formed on the inner circumferential face of the ring member 141, regulating relative movements of the ring member 141 with respect to the port member main body 121 in the X direction. When the ring member 141 is fitted into the fitting portion 128 of the port member main body 121, the opening side portion 13 of the folded neck 11 is interposed between the outer circumferential face of the fitting portion 128 and the inner circumferential face of the ring member 141.

Hereinabove, assembly of the bag with a port member is completed. Note that adhesion of the neck 11 to the port member main body 121 may be performed after fitting of the ring member 141.

When the assembly of the bag with a port member is completed, the connection side opening 125 is covered by a cap, or the entire bag with a port member is packaged with another bag, and then, this bag with a port member undergoes a radiation process of gamma rays or electron beams so as to be sterilized.

The sterilized bag with a port member is opened in, for example, a clean area of a pharmaceutical preparation manufacturing factory, connected to a tank or the like, in the area, and contents of the tank are input into the bag 10 of the bag with a port member. Then, in order to perform a predetermined operation on the contents in the bag 10, this bag with a port member is connected to another tank to perform the operation, and contents of the bag are input into the tank.

Herein, a configuration of the tank to which the bag with a port member is connected will be described.

Figure 12:
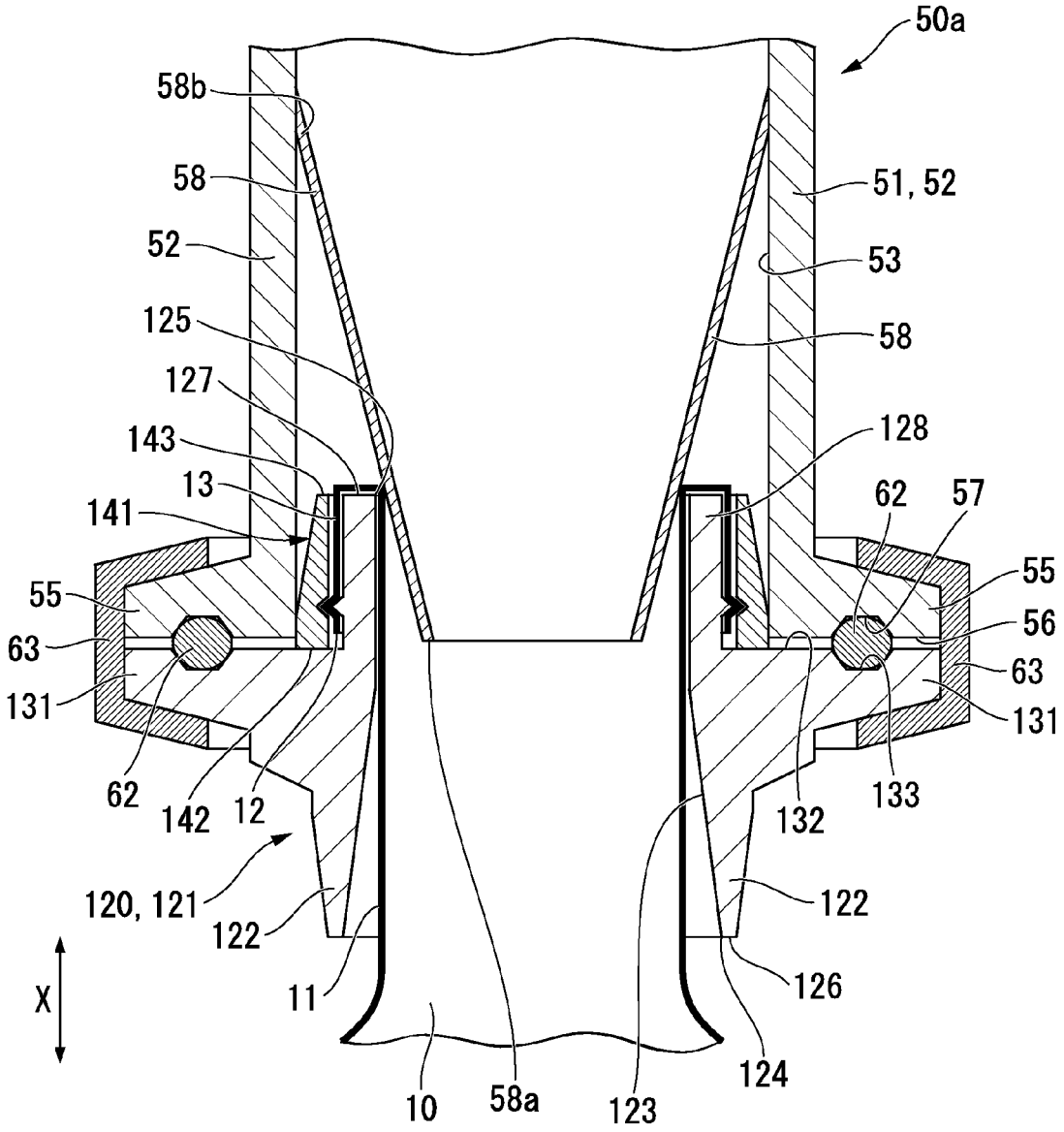
FIG. 12 is a cross-sectional view of a connection nozzle of the port member and a supply tank according to the second embodiment of the present invention.
Figure 13:
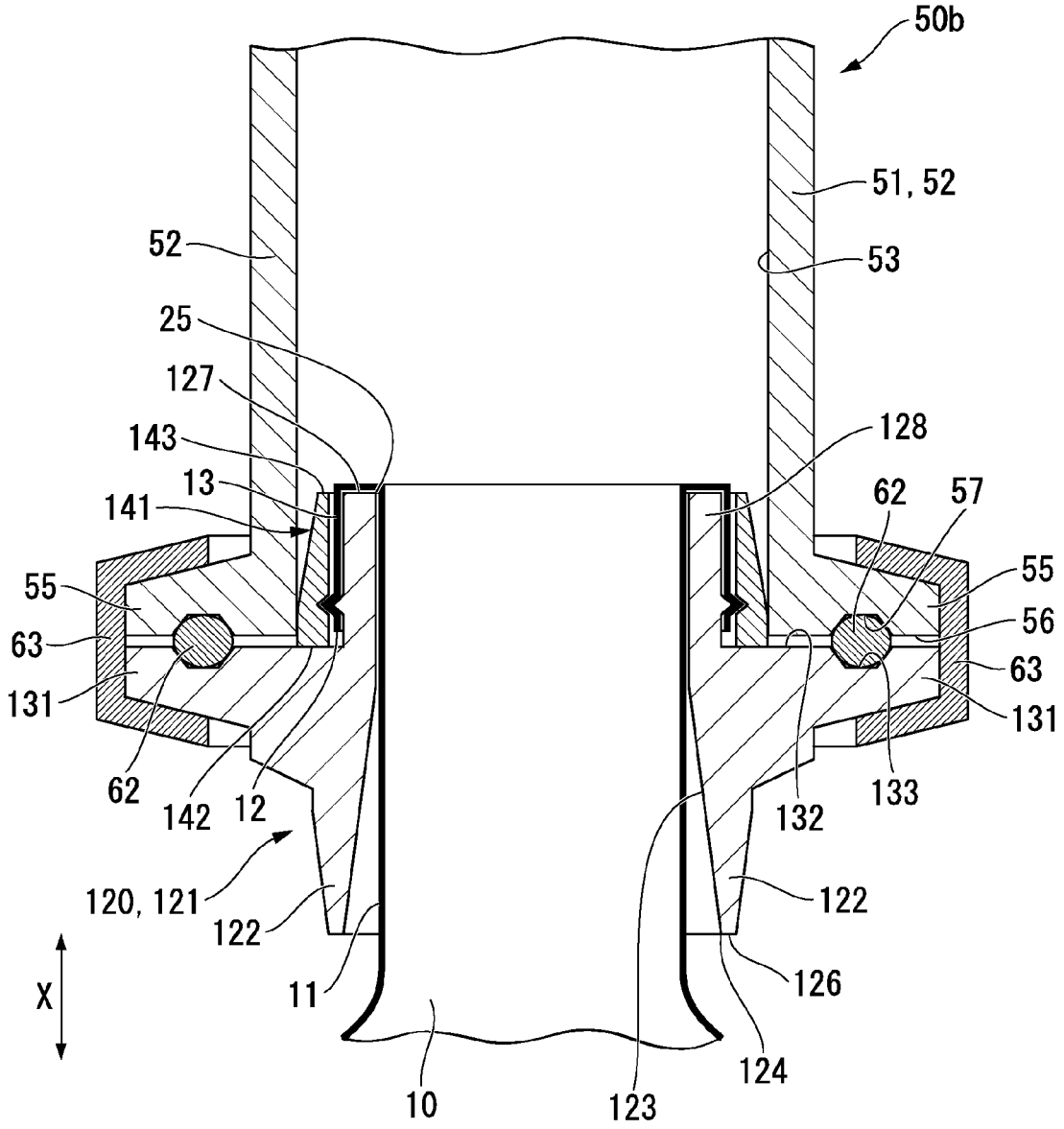
FIG. 13 is a cross-sectional view of a connection nozzle of the port member and a receiving tank according to the second embodiment of the present invention.

In the present embodiment, as the tank to which the bag with a port member is connected, there are the supply tank **50*a* that supplies contents to the bag with a port member as shown in FIG. 12, and the receiving tank 50***b* that receives contents from the bag with a port member as shown in FIG. 13.

Both of the supply tank 50*a* and the receiving tank 50*b* have the tank main bodies (not shown) and the connection nozzles 51 formed in the tank main bodies. Each connection nozzle 51 has the cylindrical connection tube 52 in which the connection port 53 is formed on an inner circumferential side and the flange portion (connection portion on the container side) 55 that is formed on the outer circumference of the end portion of the connection tube 52.

The inner diameter of the connection tube 52, in other words, the opening diameter of the connection port 53 is substantially the same as the maximum outer diameter of the ring portion 141 as described above, in other words, the outer diameter of a portion of the ring portion 141 positioned on the other end side thereof in the X direction. In addition, the outer diameter of the flange portion 55 is the same as that of the flange portion 131 of the port member 120.

On the connection face 56 of the flange portion 55, the circular seal groove 57 is formed. Each dimension of the seal groove 57 corresponds to that of the seal groove 133 of the flange portion 131 of the port member 120. In other words, the diameters and depths of both seal grooves 33 and 57 are substantially the same.

The connection nozzle 51 of the supply tank 50*a* has the chute 58 that is disposed inside the connection port 53, in addition to the above-described connection tube 52 and the flange portion 55, as shown in FIG. 12. The outer diameter of an end portion 58*a* of the chute 58 on the other end side in the X direction is smaller than the inner diameter of the connection side opening 125 of the port member main body 121, and located at the same position as a connection face 56 of a flange portion 55 in the X direction. Note that the chute 58 may have the outer diameter of the end portion 58*a* thereof on the other end side in the X direction smaller than the inner diameter of the connection side opening 25 of the port member main body 21, and may have a portion, for example, having the same diameter even though the diameter does not gradually decrease. A shutter (not shown) that controls outflow of contents from the tank main body to the connection port 53 is provided in the connection nozzle 51 or in the tank main body.

Note that the connection nozzle 51 of the supply tank 50*a* is installed on the lower side of the tank main body, and the bag with a port member is installed in the lower part of this connection nozzle 51. Thus, the one end side in the X direction is the upper part in FIG. 12. In addition, the connection nozzle 51 of the receiving tank 50*b* is installed on the upper side of the tank main body, and the bag with a port member is installed in the upper part of the connection nozzle 51. Thus, the one end side in the X direction is the lower part in FIG. 13.

Next, an input of contents from the supply tank 50*a* into the bag with a port member will be described using FIG. 12.

First, the O-ring 62 is fitted into a seal groove 133 of the flange portion 131 of the bag with a port member. Next, the connection faces 132 and 56 of both flange portions 131 and 55 are set to be facing so that the O-ring 62 fitted into the seal groove 133 is fitted into the seal groove 57 of the flange portion 55 of the supply tank 50*a*, and the bag with a port member thereby approaches the supply tank 50*a*.

As the flange portion 131 of the bag with a port member approaches the flange portion 55 of the supply tank 50*a*, the ring member 141 of the bag with a port member starts to be slotted into the connection port 53 of the supply tank 50*a*. As described above, the opening diameter of the connection port 53 of the tank to which the bag with a port member is connected is substantially the same as the outer diameter of the ring member 141 on the other end side in the X direction, and the outer diameter of the ring member 141 on the one end side in the X direction gradually decreases toward the one end side in the X direction so as to become the minimum outer diameter on the end face 143 on the one end side in the X direction. For this reason, even when the flange portion 131 of the bag with a port member is a little deviated from the flange portion 55 of the supply tank 50*a* in the direction perpendicular to the X direction in the course in which the flange portion 131 of the bag with a port member approaches the flange portion 55 of the supply tank 50*a*, the outer circumferential face of the ring member 141 functions as a guide in that direction, and such deviation in that direction is corrected.

In addition, when the ring member 141 of the bag with a port member starts to be slotted into the connection port 53 of the supply tank 50*a*, the chute 58 of the supply tank 50*a* starts to be slotted into the insertion hole 123 of the bag with a port member. In other words, the ring member 141 of the bag with a port member and the fitting portion 128 of the port member main body 121 fitted into the ring member 141 start to be slotted into a gap formed between an inner circumferential side of the connection port 53 of the supply tank 50*a* and an outer circumferential side of the chute 58 of the supply tank 50*a*.

As the flange portion 131 of the bag with a port member further approaches the flange portion 55 of the supply tank 50*a*, the O-ring 62 that has been fitted into the seal groove 133 of the flange portion 131 of the bag with a port member starts to be fitted into the seal groove 57 of the flange portion 55 of the supply tank 50*a*. The O-ring 62 that has been fitted into the seal groove 133 of the flange portion 131 of the bag with a port member is a convex member against the flange portion 55 of the supply tank 50*a*. For this reason, this O-ring 62 also functions as positioning means relative to one flange portion and the other flange portion in the direction perpendicular to the X direction, together with the inclined outer circumferential face of the ring member 141. For this reason, relative positions of both flange portions 131 and 55 can be correctly determined during connection of both flange portions 131 and 55.

When the inner circumferential face of the connection portion 53 of the supply tank 50*a* comes into contact with the outer circumferential face of the end portion of the ring member 141 on the other end side in the X direction, the flange portion 131 of the bag with a port member no longer approaches the flange portion 55 of the supply tank 50*a*. Thus, at this point of time, relative positions of both flange portions 131 and 55 are determined in the X direction and the direction perpendicular to the X direction.

When the relative positions of both flange portions 131 and 55 in the X direction and the direction perpendicular to the X direction are determined, both flange portions 131 and 55 are connected to each other using the connection clamp 63.

When the connection of both flange portions 131 and 55 is completed, the shutter (not shown) in the supply tank 50*a* is opened, and the contents in the tank main body of the supply tank 50*a* are thereby input to the bag with a port member.

In the stage in which the connection of both flange portions 131 and 55 is completed, the top of the chute 58 of the supply tank 50*a* is slotted into the insertion hole 123 of the bag with a port member. For this reason, the contents inside the supply tank 50*a* can be securely input into the bag 10 without flowing out of the bag 10 of the bag with a port member. In addition, in the present embodiment, since the O-ring 62 as a seal member is interposed between both flange portions 131 and 55 as described above, leakage of the contents from the connected portion of both flange portions 131 and 55 can be prevented.

Note that the O-ring 62 is used as a seal member in the above, but any seal member may be used as long as a portion to be fitted is provided in the seal grooves 133 and 57 of the respective flange portions 131 and 55, and for example, a gasket may be used instead of the O-ring 62.

Next, an input of contents from the bag with a port member to the receiving tank 50*b* will be described using FIG. 13.

Also in this case, the flange portion 131 of the bag with a port member is connected to the flange portion 55 of the receiving tank 50*b* in the same manner as the connection of the flange portion 131 of the bag with a port member and the flange portion 55 of the supply tank 50*a* as described above. However, in order not to cause contents of the bag with a port member to flow out in the connection process, the bag main body 15 is folded with respect to the neck 11 near the boundary line of the neck 11 of the bag 10 and the bag main body 15 so that the bottom side of the bag main body faces downward.

When the connection of the flange portion 131 of the bag with a port member and the flange portion 55 of the receiving tank 50*b* is completed, the bag main body 15 is positioned higher than the neck 11 by holding up the bag main body 15 of the bag 10 so as to input the contents in the bag main body 15 into the receiving tank 50*b*.

When a hard member is attached to the flexible bag using a method in which the periphery of the opening of the flexible bag is tucked between a hard member disposed on the inner circumference side and a hard member disposed on the outer circumference side, or a method in which an inner circumference face in the periphery of the opening of the flexible bag is made to adhere to an outer circumferential face of the hard member disposed on the inner circumferential face side, the hard member disposed on the inner circumference side of the bag serves as an obstruction when contents inside the bag are taken out from the bag, and contents of the bag thereby are left in a portion of the hard member disposed on the inner circumference side. On the other hand, in the present embodiment, the neck 11 of the bag 10 is folded making the film forming the bag 10 to be double in the neck 11, and the film on the outer circumferential side is tucked between the insertion portion 122 disposed on the inner circumferential side and the ring member 141 disposed on the outer circumferential side. For this reason, in the bag on the bag main body 15 side rather than the folded portion, there is no member into which the film of the bag 10 is tucked or attached. Thus, in the present embodiment, since there is no obstruction inside the bag 10 when the contents of the bag are taken out from the bag 10, a residual amount of contents can be reduced.

In addition, in the present embodiment, the inner circumferential face of the insertion hole 123 and the outer circumferential face of the neck 11 do not adhere to each other. Furthermore, in the present embodiment, the diameter of a portion of the insertion hole 123 on the other end side in the X direction, that is, a portion of the insertion hole 123 on the bag main body side gradually increases toward the bag main body side, and a gap between the inner circumferential face of the insertion hole 123 and the outer circumferential face of the neck 11 becomes larger. For this reason, when the bag main body 15 is shaken with respect to the port member 20 so as not to leave contents in the bag 10, the neck 11 inside the insertion hole 123 is also shaken accompanied by the shaking of the bag main body 15, and thereby a residual amount of contents inside the bag 10 can be effectively reduced.

As described above, a residual amount of content in the bag 10 can be reduced to be as small as possible also in the present embodiment.

Note that, in each of the embodiments described above, the cross-sectional shape of the insertion holes 23 and 123 are set to be a circle, but the shape may be an oval, a square, or a triangle. However, since a circle does not have directionality with respect to various directions within a plane perpendicular to the X direction, the circle is most preferable for the cross-sectional shape of the insertion holes 23 and 123 as described in each of the embodiments above.

In addition, in each of the embodiments described above, the bag 10 has the neck 11 in which the opening 12 is formed and the bag main body 15 that is continuous from the neck 11 as exemplified in FIG. 2, and the bag 10 of which the width size W2 of the neck 11 is smaller than the maximum width W1 of the bag main body 15 is used, but the shape of the bag 10 is not particularly limited. For example, the bag 10 of a simple tubular shape in which the neck 11 is not differentiated from the bag main body 15 may also be used.

In addition, in the embodiment shown in FIGS. 9 to 13, out of the two members constituting the port member 120, the flange portion 131 is formed in the port member main body 121 as a connection portion, but the flange portion 131 may be formed in the ring member 141. In addition, in this embodiment, the flange portion 131 constitutes the connection portion, but a male screw may be formed on the outer circumference of the ring member 141 or the outer circumference of the port member main body 121 so as to be set as the connection portion.

INDUSTRIAL APPLICABILITY

According to the present invention, a bag with a port member that can reduce a residual amount of contents to be as small as possible when the contents inside a bag are taken out can be provided.

REFERENCE SIGNS LIST

10: bag, 11: neck, 12: opening, 13: opening side portion, 15: bag main body, 17: through hole, 20, 120: port member, 22, 122: insertion portion, 23, 123: insertion hole, 24, 124: bag main body side opening, 25, 125: connection side opening, 26, 126: bag main body side end face, 27: connection side end face, 28 step portion, 29, 129: convex portion, 31, 131: flange portion (bag side connection portion), 33, 133: seal groove, 30: tapered portion, 34: thickness portion, 50*a*: supply tank 50*b*: receiving tank, 51: connection nozzle, 52: connection tube, 53: connection port, 55: flange portion (container side connection portion), 57: seal groove, 62: O-ring, 63: connection clamp, 121: port member main body, 128: fitting portion, 129: convex portion, 141: ring member, 149: concave portion

The invention claimed is:

1. A bag with a port member comprising:

a bag shaped member having an opening; and a port member formed in a periphery of the bag-shaped member using insert molding and attached to the opening so as not to form a gap at a welded portion between the port member and the bag-shaped member;

wherein the port member has a tubular insertion portion and a flange portion that is formed in an outer circumference of the tubular insertion portion as a connection portion, wherein the flange portion that is formed at a position that is separated from an end face of the port member, wherein the bag-shaped member is positioned on the innermost circumferential face side of the port member on an inner face of the insertion portion without any obstruction on an inner periphery of the bag-shaped member, and wherein a step portion formed by reducing the diameter of an inner circumferential face of the insertion portion toward the end portion side of the bag-shaped member side is formed along the circumferential direction of the insertion portion, and an end edge of the step portion on the bag-shaped member side and of an end face of the bag-shaped member on the opening side are located on the same position along an extension direction of the port member.

2. The bag with a port member according to claim 1, wherein a tapered portion formed by reducing the thickness of the insertion portion is provided at an end portion of the insertion portion on the bag-shaped member side.

3. The bag with a port member according to claim 1, wherein the bag-shaped member has seal parts that are formed by sealing rims of synthetic resin films that constitute the bag-shaped member using heat sealing, and thickness portions formed by increasing the thickness of the insertion portion are formed in portions that overlap the seal parts at an end portion of the insertion portion on the bag-shaped member side.

4. The bag with a port member according to claim 1, wherein the bag-shaped member has a neck in which the opening is formed and a bag main body that is connected on the side opposed to the side on which the opening of the neck is formed, wherein the port member has a port member main body that includes the tubular insertion portion in which an insertion hole into which the neck of the bag-shaped member is inserted is formed and a ring member into which the insertion portion is fitted on the inner circumference side, wherein the bag-shaped member is attached to the port member in such a way that the neck of the bag is inserted into the insertion hole from a bag main body side opening on one side out of openings on both ends of the insertion hole and comes out of the insertion hole from a connection side opening on the other side of the insertion hole, and in the neck, an opening side portion of the neck that comes out of the insertion hole is folded so as to follow an outer circumferential face of the insertion portion so as to be interposed between an inner circumferential face of the ring member and the outer circumferential face of the insertion portion that is fitted on the inner circumference side of the ring member, and wherein the bag side connection portion is formed on either of an outer circumference side of the port member main body or of the ring member.

5. The bag with a port member according to claim 4, wherein the port member main body has a flange portion as the bag side connection portion outwardly protruding along the radial direction of the insertion portion from a position that is on the outer circumferential face of the insertion portion and is on the bag main body side opening side with respect to the connection side opening of the insertion hole.

6. The bag with a port member according to claim 4, wherein, on one face of the inner circumferential face of the ring member or the outer circumferential face of the insertion portion, a convex portion that projects on the other face side is formed, and a concave portion into which the convex portion is fitted is formed on the other face side.

7. The bag with a port member according to claim 4, wherein the neck of the bag is not adhered to the inner circumferential face of the insertion hole, and thereby a portion of the neck that faces the inner circumferential face of the insertion hole can be relatively displaced on the inner circumferential face in a radial direction of the insertion hole.

8. The bag with a port member according to claim 4, wherein handles that are formed by outwardly extending the diameter of an outer circumferential face of the port member main body in the radial direction are formed, and positions of the handles define a range which is permitted to an operator in touching the port member main body during handling of the bag with a port member.

* * * * *